US010513317B2

(12) United States Patent
Schaub

(10) Patent No.: US 10,513,317 B2
(45) Date of Patent: Dec. 24, 2019

(54) EXTENDABLE LADDER FOR WATERCRAFT

(71) Applicant: Corey L. Schaub, Traverse City, MI (US)

(72) Inventor: Corey L. Schaub, Traverse City, MI (US)

( * ) Notice: Subject to any disclaimer, the term of this patent is extended or adjusted under 35 U.S.C. 154(b) by 0 days.

(21) Appl. No.: 15/795,998

(22) Filed: Oct. 27, 2017

(65) Prior Publication Data

US 2018/0118308 A1 May 3, 2018

Related U.S. Application Data

(60) Provisional application No. 62/414,297, filed on Oct. 28, 2016.

(51) Int. Cl.
*B63B 27/14* (2006.01)

(52) U.S. Cl.
CPC ..... *B63B 27/146* (2013.01)

(58) Field of Classification Search
CPC ..... B63B 27/146; B63B 25/00; E06C 1/08
See application file for complete search history.

(56) References Cited

U.S. PATENT DOCUMENTS 597,706 A * 1/1898 Brown ..... E06C 9/14 182/95
988,593 A * 4/1911 Poss ..... E06C 9/14 182/95
2,536,966 A * 1/1951 Teller ..... B63B 27/14 182/95
2,841,246 A * 7/1958 Lamb ..... B63B 27/146 414/139.5
3,892,290 A * 7/1975 Lang ..... B63B 27/146 182/22
4,541,507 A * 9/1985 Gibellato ..... B63B 27/14 182/164
4,989,691 A * 2/1991 Wilkerson ..... B63B 27/146 114/362
5,022,491 A * 6/1991 Gill ..... E06C 9/14 182/163
5,924,521 A * 7/1999 Crockett ..... B63B 27/14 182/106

(Continued)

FOREIGN PATENT DOCUMENTS

DE 10201376 A1 * 7/2003 ..... B63B 27/146
GB 1113570 A * 5/1968 ..... B63B 27/146
GB 2332698 A * 6/1999 ..... B63B 27/146

*Primary Examiner* — Catherine A Kelly
*Assistant Examiner* — Candace L Bradford
(74) *Attorney, Agent, or Firm* — Taylor IP, P.C.

(57) ABSTRACT

A watercraft including a frame and a folding ladder coupled to the frame. The folding ladder is configured for moving in between a folded position and an unfolded position. The ladder includes a stabilizing portion connected to the frame and defining a stabilizing plane and a first stair portion pivotably connected to the stabilizing portion. The first stair portion pivots relative to the stabilizing portion in a first direction of rotation. The ladder further includes a second stair portion pivotably connected to the first stair portion. The second stair portion pivots relative to the first stair portion in a second direction of rotation which is opposite to the first direction of rotation of the first stair portion such that the ladder selectively folds between the folded position and the unfolded position.

6 Claims, 10 Drawing Sheets

(56) References Cited

U.S. PATENT DOCUMENTS

| | | | | |
|---|---|---|---|---|
| 7,370,598 | B1 * | 5/2008 | Bootes | B63B 27/146 114/362 |
| 8,297,215 | B1 * | 10/2012 | Chinn | B63B 17/04 114/362 |
| 9,169,066 | B2 * | 10/2015 | Morikawa | B65G 1/02 |
| 9,512,675 | B1 * | 12/2016 | Fast | E06C 1/34 |
| 2018/0118308 | A1 * | 5/2018 | Schaub | B63B 27/146 |

* cited by examiner

EXTENDABLE LADDER FOR WATERCRAFT

CROSS REFERENCE TO RELATED APPLICATIONS

This is a non-provisional application based upon U.S. provisional patent application Ser. No. 62/414,297, entitled "EXTENDABLE LADDER FOR WATERCRAFT", filed Oct. 28, 2016, which is incorporated herein by reference.

DESCRIPTION OF THE INVENTION

1. Field of the Invention

The present invention relates to attachments for water vehicles, and more particularly, to a ladder for use on a boat.

2. Description of the Related Art

Typical marine ladders can include a pair of vertical support members with horizontal steps attached in between the vertical support members. Generally, marine ladders may either be rigidly fixed to the boat or moveably connected to the boat in order for the ladder to be maneuvered into a stowed position. Some moveably connected ladders can be rotatable about a fixed point, foldable at a hinge point, and/or the ladder may telescope to shorten the overall length of the ladder. Due to design constraints such as limited space on a boat, marine ladders can be too short with too few steps, impractically compact, and/or attached to the boat at a location that sacrifices ease of use to minimalize the ladder's stored volume. As a result, marine ladders are notoriously known for being arduous to climb and maneuver into and out of a stowed position.

Ease of use, i.e. ascending the ladder, can be an issue with ladders that are impractically compact and/or connected to the boat in a manner that hinders its operational use. Ladders that are undesirably compact may lack the sturdiness for users to easily ascend, especially users who are elderly, physically unfit, or may be wearing aquatic gear, e.g., scuba gear. The connection point at which the ladder is affixed to the boat may also hinder ease of use, such as when the steps of the ladder are oriented nearly vertical and have a narrow width. A user ascending such a ladder often has a difficult time positioning his center of gravity in front of him in order to step onto the boat. Further, ladders with a connection point too close to the boat may also cause the user to experience uneasiness as a result of excessive swinging of the ladder due to the combination of water movement and the user's inability to maintain his center of gravity afore him.

Also, the maneuverability of moveably attached marine ladders can be an issue. Normally, a user has to manually let the ladder down into the water, which can be time consuming and cumbersome depending upon the ladder at issue. Additionally, manually pulling a ladder up out of the water can be especially difficult and strenuous. For instance, maneuvering a folding tube ladder into the stowed position may be difficult because the design of the tube ladder may limit the expulsion of water from within the ladder as the ladder is being folded into the vertically upward position, and thereby a user must not only lift the weight of the ladder but also the weight of the water which has seeped into the ladder.

What is needed in the art is a ladder for use on a boat that does not compromise maneuverability and ease of use.

SUMMARY OF THE INVENTION

The present invention provides a folding ladder for use on a watercraft. The folding ladder includes a stabilizing portion, a first stair portion and a second stair portion that rotate in opposite directions, and a tensioning system. The stabilizing portion includes mounting rails and surface rails which slideably engage with one another in order to selectively engage the ladder to the watercraft. The tensioning system includes a pre-tensioner and a cable internally disposed within the ladder.

The invention in one form is directed to a watercraft including a frame and a folding ladder coupled to the frame. The folding ladder is configured for moving in between a folded position and an unfolded position. The ladder includes a stabilizing portion connected to the frame and defining a stabilizing plane and a first stair portion pivotably connected to the stabilizing portion. The first stair portion pivots relative to the stabilizing portion in a first direction of rotation. The ladder further includes a second stair portion pivotably connected to the first stair portion. The second stair portion pivots relative to the first stair portion in a second direction of rotation which is opposite to the first direction of rotation of the first stair portion such that the ladder selectively folds between the folded position and the unfolded position.

The invention in another form is directed to a folding ladder. The folding ladder includes a stabilizing portion defining a stabilizing plane and a first stair portion pivotably connected to the stabilizing portion. The first stair portion pivots relative to the stabilizing portion in a first direction of rotation. The ladder further includes a second stair portion pivotably connected to the first stair portion. The second stair portion pivots relative to the first stair portion in a second direction of rotation which is opposite to the first direction of rotation of the first stair portion such that the ladder selectively folds between a folded position and an unfolded position.

The invention in yet another form is directed to a method for operating a watercraft. The method includes the steps of providing a folding ladder mounted to the watercraft. The folding ladder is configured for moving in between a folded position and an unfolded position. The ladder includes a stabilizing portion connected to the watercraft and defining a stabilizing plane and a first stair portion pivotably connected to the stabilizing portion. The first stair portion pivots relative to the stabilizing portion in a first direction of rotation. The ladder further includes a second stair portion pivotably connected to the first stair portion. The second stair portion pivots relative to the first stair portion in a second direction of rotation which is opposite to the first direction of rotation of the first stair portion such that the ladder selectively folds between the folded position and the unfolded position. The method includes the additional step of pivoting the first stair portion in the first direction of rotation, in order to place the ladder in the folded position, such that the first stair portion pivots upwardly and inwardly toward the watercraft, and the second stair portion pivoting in the second direction of rotation and folding adjacent to and parallel with the first stair portion. The method includes the additional step of pivoting the first stair portion away from the watercraft, in order to place the ladder in the unfolded position, such that the first stair portion defines a first stair angle, which is angled with respect to the stabilizing plane, and the second stair portion pivoting outwardly from the watercraft to define a second stair angle, which is angled with respect to the first stair portion and perpendicular relative to the stabilizing plane.

An advantage of the present invention is that the ladder is easy to operate in moving the ladder in between the folded and unfolded position due to the folding relationship of the first and second stair portions and the tensioning system.

Another advantage of the present invention is that the ladder may be efficiently and selectively mounted to the frame of the watercraft.

Yet another advantage of the present invention is that the ladder may be sufficiently long yet have a reduced profile in the folded position as a result of the folding relationship of the first and second stair portions.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrates embodiments of the invention and such exemplifications are not to be construed as limiting the scope of the invention in any manner.

DETAILED DESCRIPTION OF THE INVENTION

Figure 1:
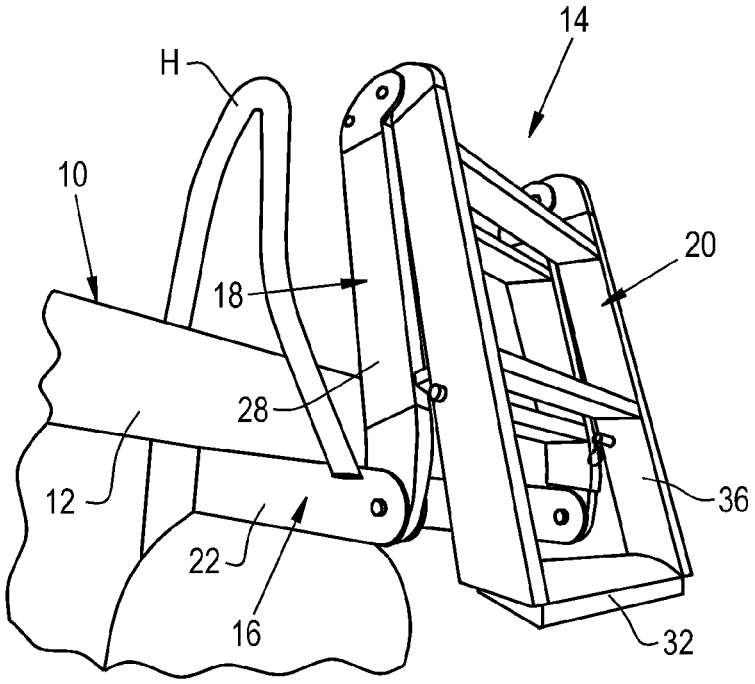
FIG. 1 is a perspective view of a watercraft with a folding ladder affixed thereto according to an embodiment of the present invention.
Figure 2:
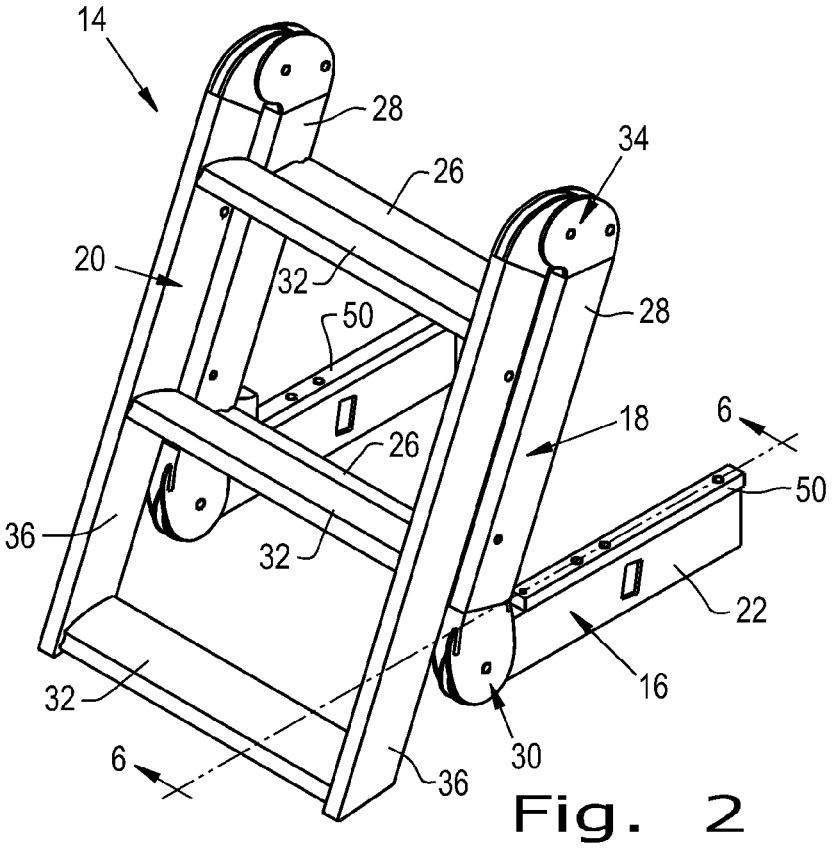
FIG. 2 is a perspective view of the ladder according to the present invention in a folded, stowed position.
Figure 3:
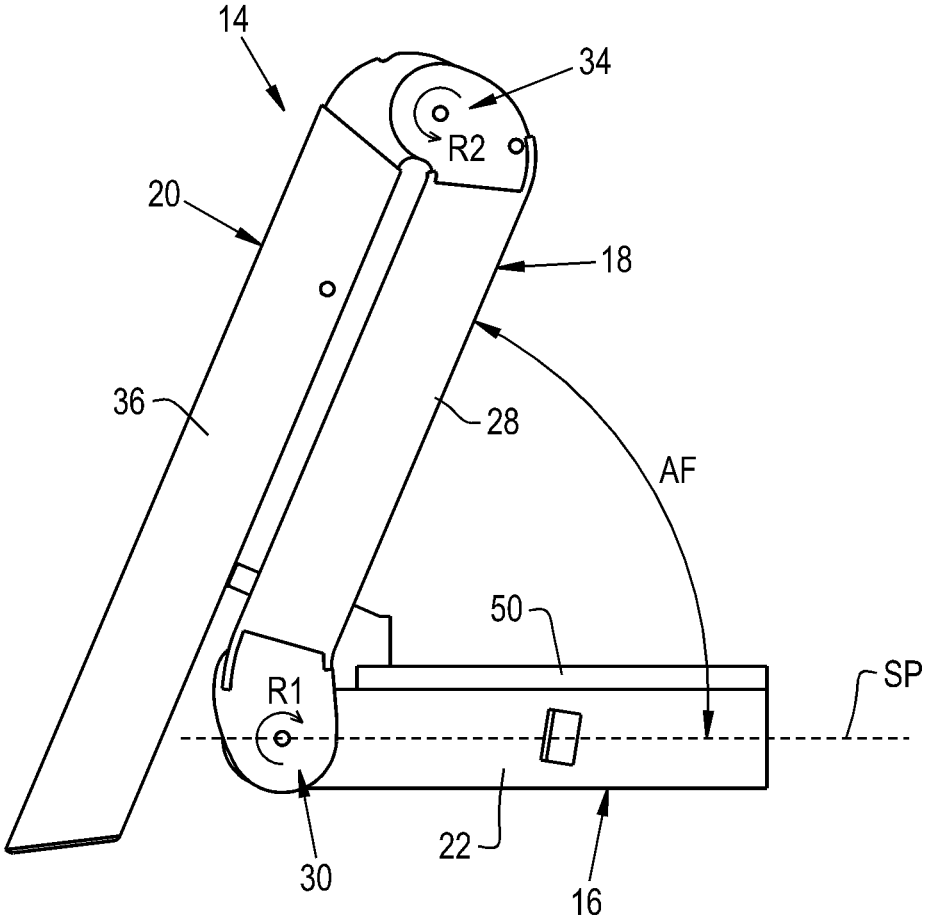
FIG. 3 is a side view of the ladder as shown in FIG. 2.
Figure 4:
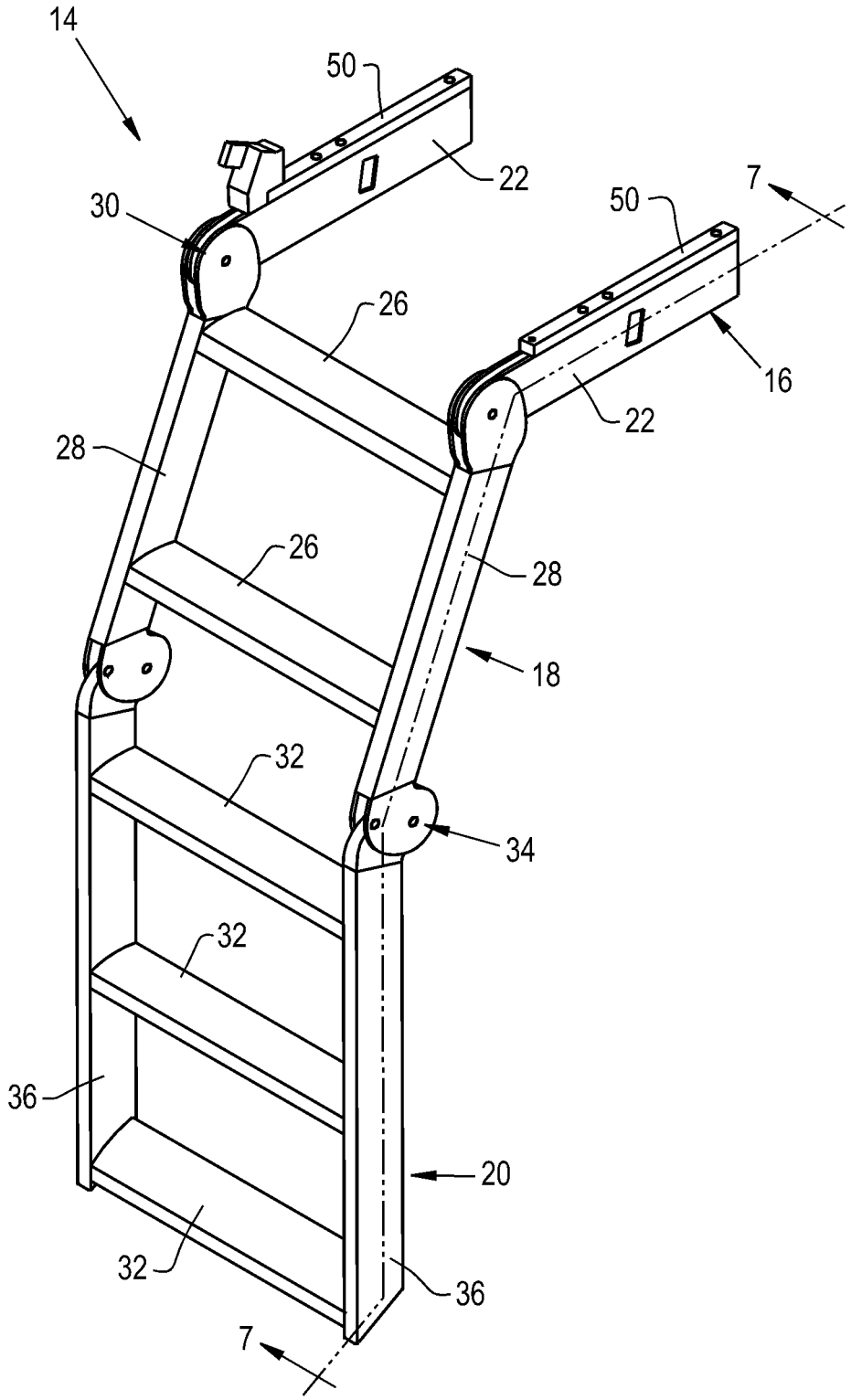
FIG. 4 is a perspective view of the ladder according to the present invention in an unfolded position.
Figure 5:
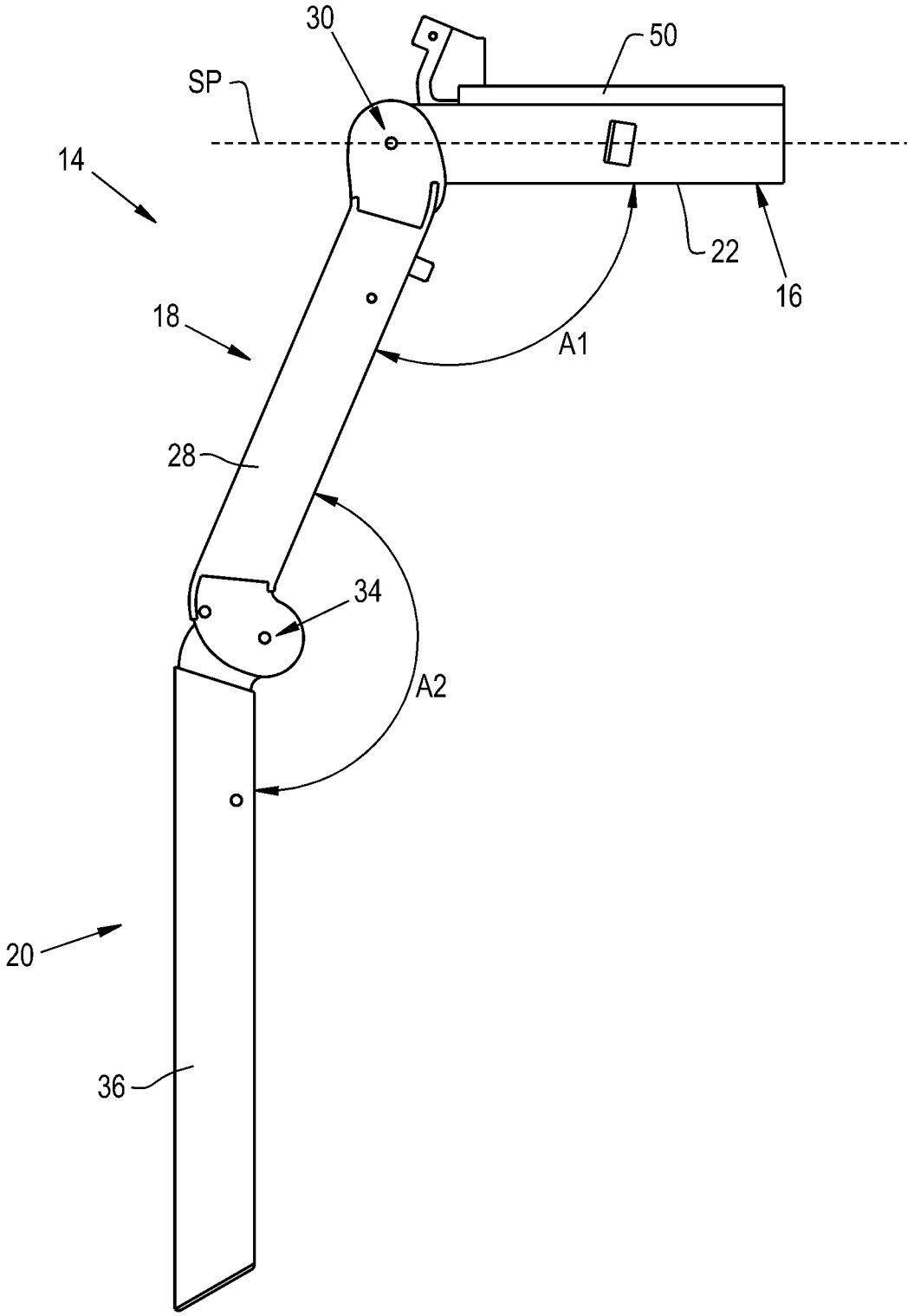
FIG. 5 is a side view of the ladder as shown in FIG. 4.

Referring to the drawings, and more particularly to FIGS. 1-5, there is shown a watercraft 10 with a frame 12 and a folding ladder 14 coupled to the frame 12. The ladder 14, which is formed according to the present invention, generally includes a stabilizing portion 16, a first stair portion 18 pivotably connected to the stabilizing portion 16, and a second stair portion 20 pivotably connected to the first stair portion 18. The ladder 14 may be maneuvered in between a folded position (FIGS. 1-3) and an unfolded position (FIGS. 4-5). The ladder 14 may also additionally include a handrail H. It should be appreciated that the ladder 14 may be incorporated in non-water traversing vehicles or affixed to stationary surfaces. For example, the ladder 14 may be used for ascending or descending from a mezzanine, a pit or tank, heavy equipment, an emergency exit, or a temporary access point.

Figure 11:
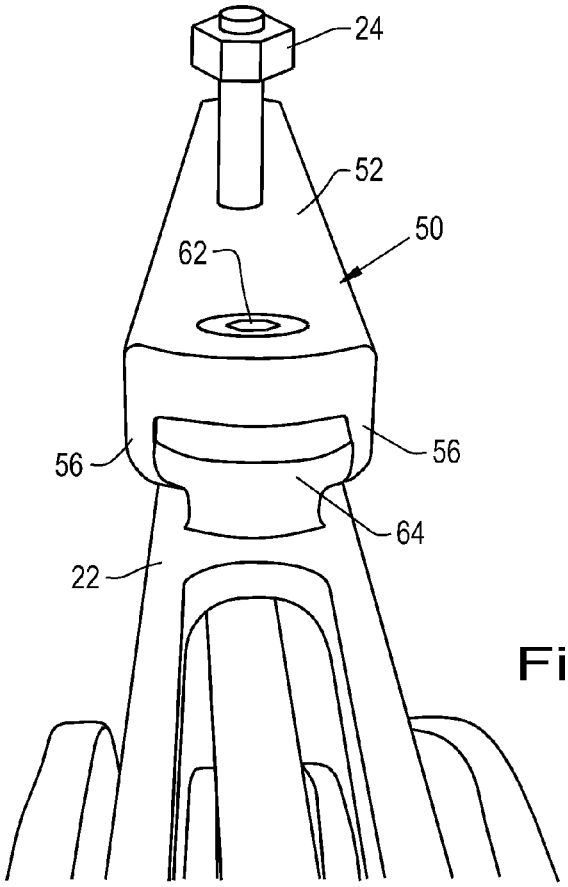
FIG. 11 is a front perspective view illustrating the connection between the stabilizing portion and the surface rail of the ladder according to the present invention.

The stabilizing portion 16 can be in the form of a mounting portion 16. The mounting portion 16 allows the first stair portion 18 of the ladder 14 to be mounted to a surface, such as the bottom surface of the frame 12 of the watercraft 10, so the stair portions 18, 20 are stable while a user climbs up and down the ladder 14. The mounting portion 16 can include a pair of mounting rails 22 that are mounted to the frame 12 by fasteners 24 or otherwise (FIG. 11). Thereby, the mounting rails 22 pivotally mount the first stair portion 18 so that the ladder 14 is firmly and stably held in place during use. The stabilizing portion 16 can be formed of any suitable material to stabilize the stair portions 18, 20 during use, including a metal such as aluminum or stainless steel.

The first stair portion 18 includes at least one step 26 and is pivotably connected to the stabilizing portion 16 such that the first stair portion 18 can pivot about a pivot point where the first stair portion 18 connects to the stabilizing portion 16. The first stair portion 18 can include a pair of first stair rails 28 which are each pivotably connected to the stabilizing portion 16 at respective hinges 30, with one or more steps 26 connecting the first stair rails 28 together. As shown, the first stair portion 18 includes two steps 26, but it should be appreciated that the first stair portion 18 can include only one step 26 or more than two steps 26. The spacing between the steps 26, if more than one is included, can be varied to adjust the size of the step a user climbing or descending the ladder 14 must take to travel up or down the ladder 14. The total length of the first stair portion 18 can be varied as well. The first stair portion 18 can be formed of any suitable material that can support the weight of a user as the user climbs or descends the ladder 14, with such materials being known. It may also be desired to form the steps 26 of a softer material so the user is more comfortable while using the ladder 14.

The second stair portion 20 can include at least one step 32, one or more pivot connections, such as hinges 34, pivotably connecting the first and second stair portions 18, 20 together, and a pair of second stair rails 36 which are connected to each other by the one or more step(s) 32. As shown, the second stair portion 20 may have three steps 32 connecting the second stair rails 36. In all other respects, the second stair portion 20 may be formed similarly to the first stair portion 18. It should be appreciated that the steps 26 of the first stair portion 18 and the steps 32 of the second stair portion 20 are vertically equidistant from one another when the ladder is extended, however the vertical spacing between the steps 26, 32 can be varied as desired.

To further assist a user in easily advancing along the ladder 14, one or more of the second steps 26, 32 of the first and second stair portions 18 20 can be angled relative to the stabilizing plane SP. The first steps 26 of the first stair portion 18 may define surfaces which are angled with respect to the first stair rails 28 so the surfaces of the first steps 26 are generally parallel to the stabilizing plane SP. The second steps 32 of the second stair portion 20 may be oriented to define step surfaces which are angled relative to the second stair rails 36 in a manner that is comfortable for a climber's feet to engage. A top step of the second stair portion 36 can also define a surface which may be approximately parallel with a surface of a bottom step 26 of the first stair portion 18. For example, the second steps 32 of the second stair portion 20 may transition from a 30-35 degree bottom step 32, facing towards the user, to horizontally positioned steps 32, e.g. the following next two steps 32 of the second stair portion 20 (FIG. 4). Additionally, for example, the steps 26 of the first stair portion 18 may be angled between 1-5 degrees from the horizontal, tipping away from the user, toward the watercraft 10. The orientation of the steps 26, 32 allows for a comfortable transition from the floating position to the initial standing position (the steps 32 of the second stair portion 20) with minimal upper body strength, as well as an ergonomic, pitched forward position (the steps 26 of the first stair portion 20), to easily transition the user from the first stair portion 20 of the ladder to the boat 10. Also, the top step of the second stair portion 36 can also define an inner edge which is aligned with an outer edge of a bottom step 26 of the first stair portion 18. It should be appreciated that due to the design of the first and second stair rails 28, 36, the steps 26, 32 may have a larger width which approximately matches the width of the stair rails 28, 36. Therefore, the steps 26, 32 of the ladder 14 make it easier for a user to balance and climb or descend the ladder 14.

When mounted on a watercraft 10, it may not always be desirable for the ladder 14 to be in an extended, unfolded position. Particularly when the watercraft 10 is moving or a driver is trying to dock the watercraft 10, the ladder 14 being extended may present a potential source of damage to both the watercraft 10 and surrounding structures. To overcome this potential damage, the ladder 14 can be pivoted to the folded position where the first stair portion 18 is pivoted about its respective hinges 30 in a first direction of rotation R1, such as clockwise as viewed in FIG. 3, and the second stair portion 20 is pivoted about its respective hinges 34 in a second direction of rotation R2, such as counter-clockwise as viewed in FIG. 3.

In the folded position, the ladder 14 may be formed so the stabilizing portion 16 defines a stabilizing plane SP and the first stair portion 18 defines a folded angle AF which is angled with respect to the stabilizing plane SP (FIG. 3). The folded angle AF may, for example, extend at an angle between 65-70 degrees relative to the stabilizing plane SP. The first stair portion 18 pivots to rest above the stabilizing plane SP defined by the stabilizing portion 16, and the second stair portion 20 pivots so an unattached end of the second stair portion 20 forms a minimal clearance relative to the stabilizing portion 16. The ladder 14 in the folded position may be configured such that the first and second stair portions 18, 20 are adjacent and parallel with one another. The ladder 14 is then significantly closer to an edge of the watercraft 10 and presents less likelihood of contacting other objects during transportation or storage of the watercraft 10.

In the unfolded position, the ladder 14 may be formed so the stabilizing portion 16 defines the stabilizing plane SP, the first stair portion 18 defines a first stair angle A1 which is angled with respect to the stabilizing plane SP, and the second stair portion 20 defines a second stair angle A2 which is angled with respect to the first stair portion 18 and perpendicular relative to the stabilizing plane SP of the stabilizing portion 16 (FIG. 5). The first stair angle A1 may, for example, extend at an angle of between 22-25 degrees relative to the vertical plane, approximately 112-115 degrees relative to the stabilizing plane SP. Hence, when the ladder 14 is mounted to the deck of the watercraft 10 and the ladder 14 is unfolded, the first stair portion 18 extends outwardly and downwardly toward a body of water that the watercraft 10 is navigating. The second stair portion 20, on the other hand, can be perpendicular relative to the stabilizing plane SP to allow a user climbing or descending the second stair portion 20 to rapidly advance into or out of the body of water. When the ladder 14 is mounted to a watercraft 10, for example, a user may still be in the water while climbing or descending the second stair portion 20. Since the user will be buoyant in the water, climbing and descending the second stair portion 20 can be easier for the user while in the water. When the user advances sufficiently to put their foot on the step(s) 26 of the first stair portion 18, the user can be partially or fully out of the water so there is little or no buoyancy force helping the user climb the first stair portion 18, making larger steps against the force of gravity more difficult. By orienting the first stair portion 18 and second stair portion 20 as shown, a user can get maximum vertical elevation while in the water (climbing the second stair portion 20) before transitioning to an angled stair portion (the first stair portion 18). In this sense, the first stair portion 18 can terminate adjacent a plane defined by a bottom surface of the watercraft 10, which will roughly define the surface of the water as the watercraft 10 floats, with the second stair portion 20 being formed substantially below the plane defined by the bottom surface of the watercraft 10.

To change the ladder 14 from the extended position (FIGS. 4-5) to the folded position (FIGS. 1-3), the stair portions 18, 20 can be pivoted about their respective hinges 30, 34. That is, the first stair portion 18 can be pivoted about its pivot connection with the stabilizing portion 16 and the second stair portion 20 can be pivoted about its pivot connection with the first stair portion 18 to fold the ladder 14. Once in the folded position, the stair portions 18, 20 can be securely locked into place using various locking mechanisms so the ladder 14 does not undesirably assume the extended position.

Figure 6:
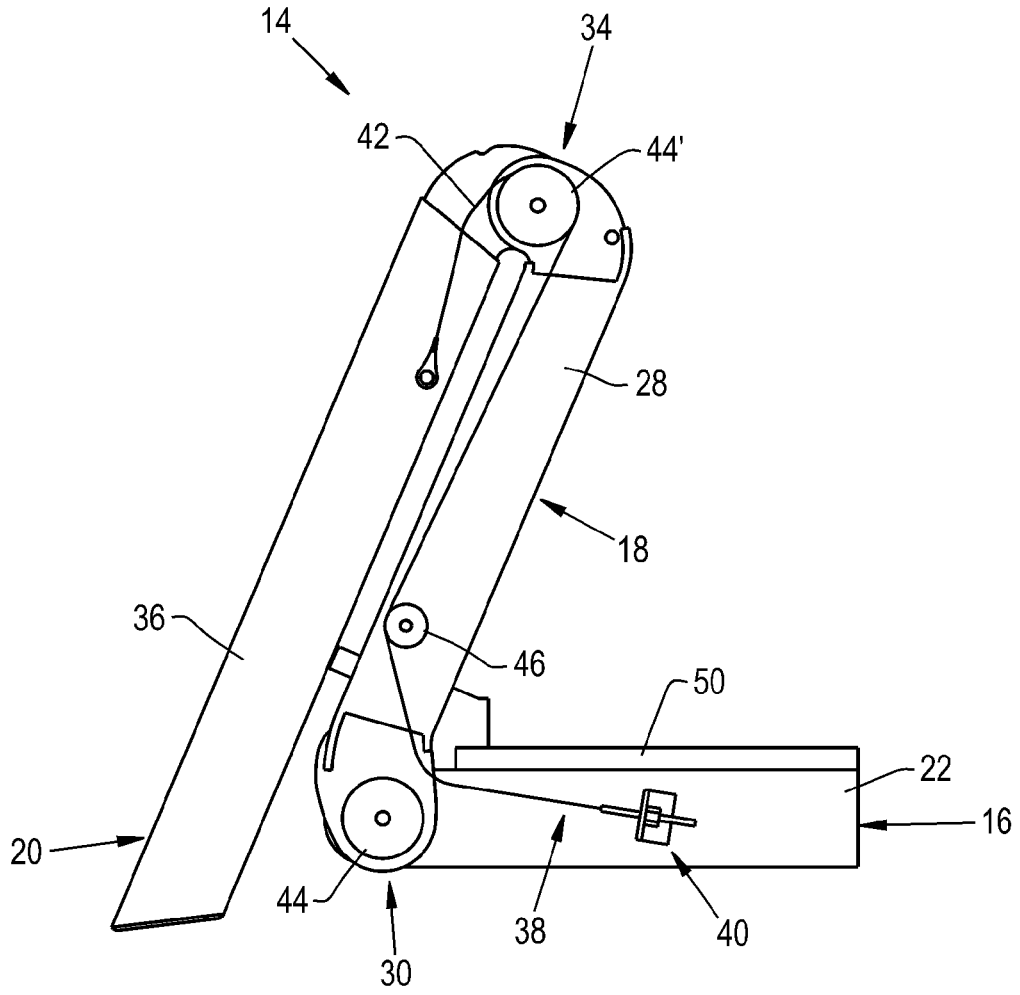
FIG. 6 is a section view of the ladder in the folded position as shown in FIG. 2, taken across line 6-6.
Figure 7:
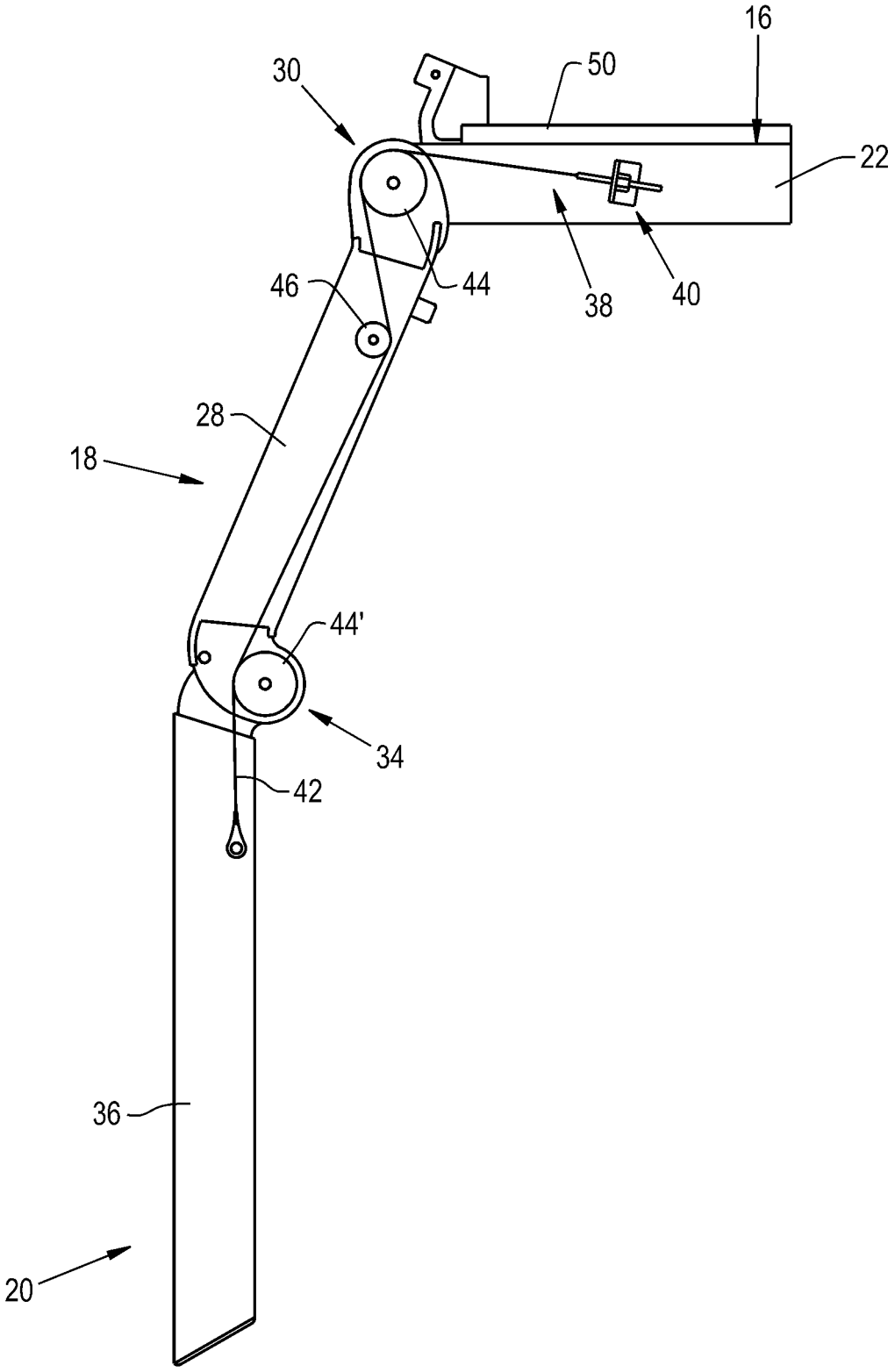
FIG. 7 is a section view of the ladder in the unfolded position as shown in FIG. 4, taken across line 7-7.
Figure 8:
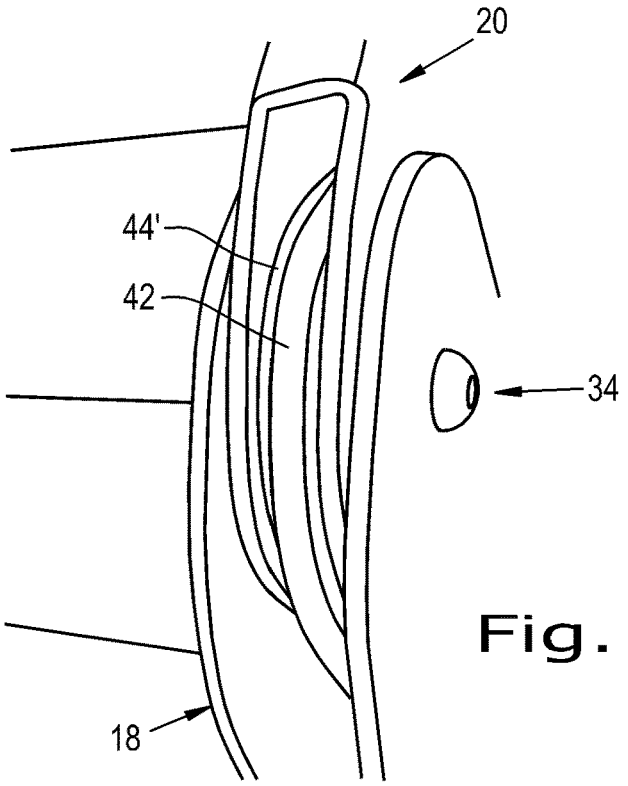
FIG. 8 is a perspective view illustrating a hinge of the ladder according to the present invention.

Referring now to FIGS. 6-8, the ladder 14 in another possible embodiment can further include a tensioning system 38. The tensioning system 38 may generally include a tensioner 40 connected to a cable 42 which extends through channels formed in the stair portions 18, 20. Since the ladder 14 may include one or more tensioner(s) 40 and cable(s) 42, one or both sides of the ladder 14, i.e., the side rails 28, 36, may house the tensioner 40 and cable 42. The tensioning system 38 may also include a respective pulley 44, 44' placed adjacent to each pivot connection of the ladder 14. Optionally, the tensioning system 38 may further include a guide pully 46 internally disposed in the first stair portion 18, and configured for guiding the cable 42 such that it remains in the correct position (FIGS. 6-7).

The tensioner 40 may be coupled to an inner portion of the stabilizing portion 16. The tensioner 40 can be any type of mechanism, such as an adjuster stud or spring-loaded member, that can produce further tension in the cable 42.

The cable 42 can have one end connected to the tensioner 40 and another end which is rigidly fixed to the second stair portion 20. The cable 42 may at least partially wrap around the pulley 44 between the stabilizing portion 16 and the first stair portion 18 and the pulley 44' between the first stair portion 18 and the second stair portion 20. The cable 42 can be pre-tensioned to a level where the cable 42 is not fully taut when the ladder 14 is in the folded position (FIG. 6), but is fully taut when the ladder 14 moves to the desired extended position (FIG. 7). Since the ladder 14 in the unfolded position is not braced at the base of the second stair portion 20 by the ground or a portion of the watercraft 10, the cable 42 provides the requisite force to limit the movement of the ladder 14. In the unfolded position, the tension in the cable 42 acts to prevent the ladder 14 from unfolding further or otherwise moving toward the watercraft 10. In this respect, the cable 42 locks the ladder 14 in the unfolded position. By adjusting the amount of pre-tension in the fixed length cable 42 through adjustment of the tensioner 40, it is therefore possible to control how far the ladder 14 is able to extend from the folded position to the unfolded position. As discussed above, once the ladder 14 is extended to the point where the cable 42 is fully taut, the cable 42 may prevent further extension of the ladder 14. Also, it should be appreciated that the cable 42 may assist in minimizing movement of the ladder 14 during use of the ladder 14; for example, the cable 42 may prevent the ladder 14 from moving forward once the user puts his weight on the ladder 14.

Figure 9:
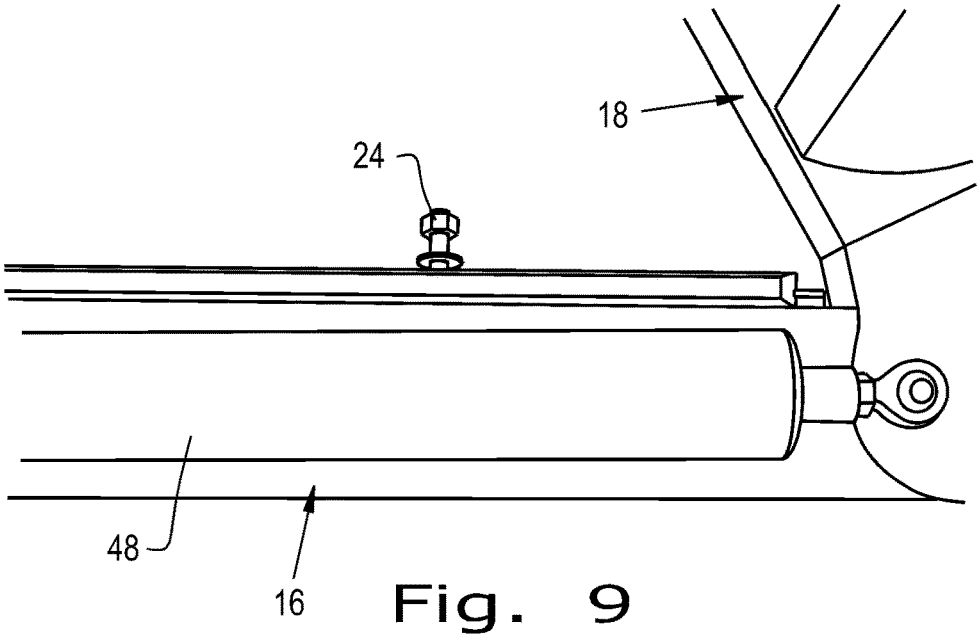
FIG. 9 is a side view illustrating an actuator which automatically folds and unfolds the ladder according to the present invention.

To fold the ladder 14, the first stair portion 18 can be pulled upwardly and inwardly by a user. As an alternative configuration, shown in FIG. 9, an actuator 48 mounted to the stabilizing portion 16 or elsewhere can pull the first stair portion 18 toward a front end of the stabilizing portion 16 to cause the ladder 14 to assume the folded position. The actuator 48, as shown, can be mounted so a retraction axis of the actuator 48 is substantially parallel to one or both of the mounting rails 22 of the stabilizing portion 16. Alternatively, the retraction axis of the actuator 48 may not be parallel with the mounting rails 22, and the actuator 48 may be mounted at a location away from the stabilizing portion 16. For example, the actuator 48 may be mounted to a separate mounting plate or to the frame 12 of the watercraft 10 so that a greater leverage may be obtained. The actuator 48 can be any type of known actuator 48, such as an electrically powered actuator, a pneumatic cylinder, or a hydraulic cylinder. The actuator 48 may also be in the form of an electric motor operably coupled with a planetary gear system which is attached to the ladder 14. To place the ladder 14 back in the extended position, the actuator 48 can be activated to push the first stair portion 18 away from the front end of the stabilizing portion 16 so the weight of the stair portions 18, 20 naturally causes pivoting about the pivot connections until the cable 42 becomes taut and prevents further extension of the second stair portion 20. It should therefore be appreciated that the tension system 38 allows a user to easily and conveniently store the ladder 14 when it is desired to minimize the effect of the ladder 14 on surrounding objects and extend the ladder 14 when it is desired to use the ladder 14 in, for example, a body of water that the watercraft 10 is navigating.

Further, extension and retraction of the ladder 14 can be tied to various activities through selective control of the actuator 48. For example, the actuator 48 can be linked to a control unit of the watercraft 10 such that the actuator 48 automatically activates to retract, thereby folding the ladder 14, whenever the watercraft 10 is placed in gear, i.e., taken out of park and/or neutral. Linking this functioning of the actuator 48 to the control unit reduces the risk of damaging the watercraft 10 or surrounding objects by inadvertently leaving the ladder 14 extended when the watercraft 10 is moving. Also, the actuator 48 can also have a switch located near the bottom surface of the watercraft 10 so a user is able to extend the ladder 16 from the water. It should therefore be appreciated that there are many possible ways of controlling the actuator 48, with the foregoing examples representing only a few of the possibilities.

As previously described, the ladder 14 can be affixed to the watercraft 10 by the stabilizing portion 16. In some instances, it may be desired for the ladder 14 to be easily separable from the frame 10 of the watercraft 10, in order to simplify installation and/or removal of the ladder 14.

Figure 10:
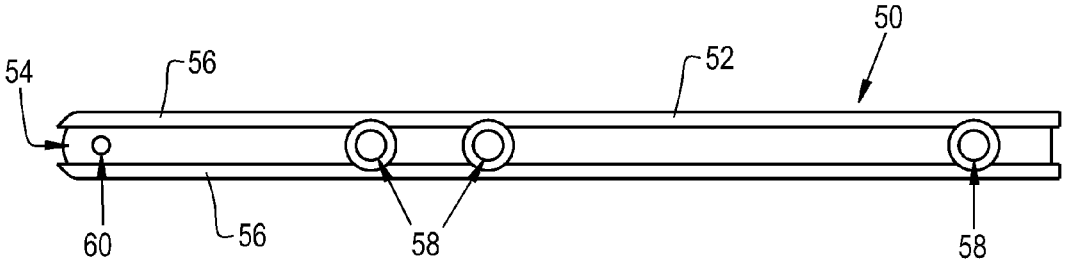
FIG. 10 is a top view illustrating a surface rail of the ladder.

Referring now to FIGS. 10-11, it can be seen that the stabilizing portion 16 can include a pair of surface rails 50 which are bolted to a surface of the watercraft 10 and connect to the mounting rails 22. As shown in FIG. 10, each surface rail 50 can include a rail body 52 with a channel 54 defined between two flanges 56 extending from the rail body 52. The rail body 52 can have one or more tapered opening(s) 58 formed therein which will accept a fastener, such as the bolt(s) 24, in order to bolt the surface rail 50 to the frame 24 of the watercraft 10. The rail body 52 may also include one or more smaller mounting opening(s) 60 which will accept a fastener, such as a screw 62, in order to connect the mounting rails 22 to the surface rails 50 and stably connect the stair portions 18, 20 to the frame 12 of the watercraft 10.

As shown in FIG. 11, each mounting rail 22 connected to the first stair portion 18 can include a protrusion 64 which is shaped and sized to firmly fit within the channel 54 of the respective surface rail 50, allowing for easy positioning of the mounting rails 22 with respect to the surface rails 50. Once the protrusion 64 is placed within the channel 54, the mounting rail 22 can slide until an opening (not shown) in the mounting rail 22 aligns with the mounting opening 60 of the surface rail 50, at which point the fastener 62 can be placed through the aligned openings to connect the mounting rail 22 to the surface rail 50. To remove the ladder 14 from the watercraft 10, the fastener 62 in the aligned openings can be removed and the mounting rails 22 can be pulled from the surface rails 50, allowing the stair portions 18, 20 to also be easily removed. By having the protrusion 64 of the mounting rails 22 rest within the channels 52 of the surface rails 50, the stabilizing portion 16 can appear as if it is a single piece, which is more visually pleasing, while also allowing for adequate support of the stair portions 18, 20 and easy installation or removal from the frame 12 of the watercraft 10.

It should be appreciated that the surface rails 50 may be previously mounted to the watercraft 10 before installation of the of the mounting rails 22 and stair portions 18, 20. For example, the surface rails 50 may be mounted to the watercraft 10 at a manufacturing factory and the rest of the ladder 14 can be easily installed subsequently at a different location by a dealer or operator of the watercraft 10. Thereby, the shipping costs associated with transporting the watercraft 10 may be reduced, e.g. decreasing the amount of protective shrink wrapping used on the watercraft 10. Additionally, it should be appreciated that the ladder 14 may be easily installed onto existing watercrafts 10 due to the ease of mounting the surface rails 50 and slideably engaging the mounting rails 22.

Figure 12:
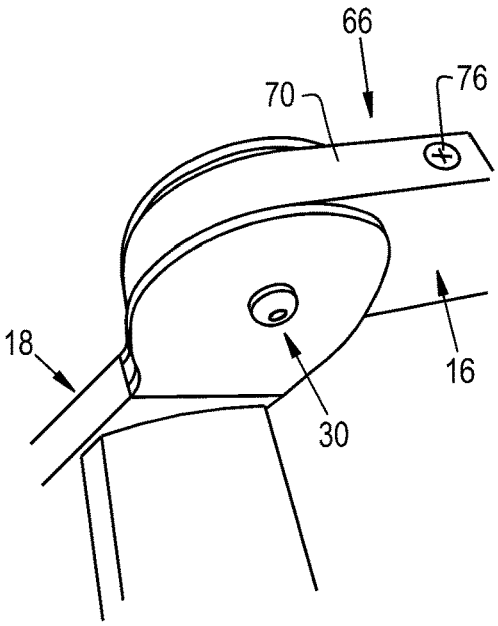
FIG. 12 is a perspective view illustrating another embodiment of a ladder with an optional protective hinge assembly in an unfolded position.
Figure 13:
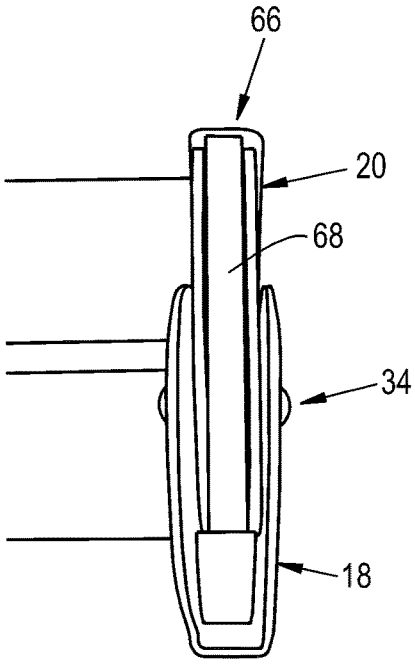
FIG. 13 is a top view illustrating the ladder with the protective hinge assembly in a folded position.

Referring now to FIGS. 12-13, there is shown another possible embodiment of the ladder 14, wherein one or all of the hinge(s) 30, 34 each include an optional protective hinge assembly 66 for protecting the hinge(s) 30, 34 by at least partially covering the cables 42 and pulleys 44, 44'. FIG. 12 illustrates the protective hinge assembly 66 on the hinges 30 in the unfolded position, and FIG. 13 illustrates the protective hinge assembly 66 on the hinges 34 in the folded position. Thereby, each hinge 30 may have a protective hinge assembly 66 which connects to the stabilizing portion 16 and the first stair portion 18, and each hinge 34 may have a protective hinge assembly 66 which connects to the first and second stair portions 18, 20. It should be appreciated that the protective hinge assemblies 66 may prevent foreign objects coming into contact with the hinges 30, 34; for example, the protective hinge assemblies 66 may guard against a user's fingers from entering the hinges 30, 34.

Figure 14A:
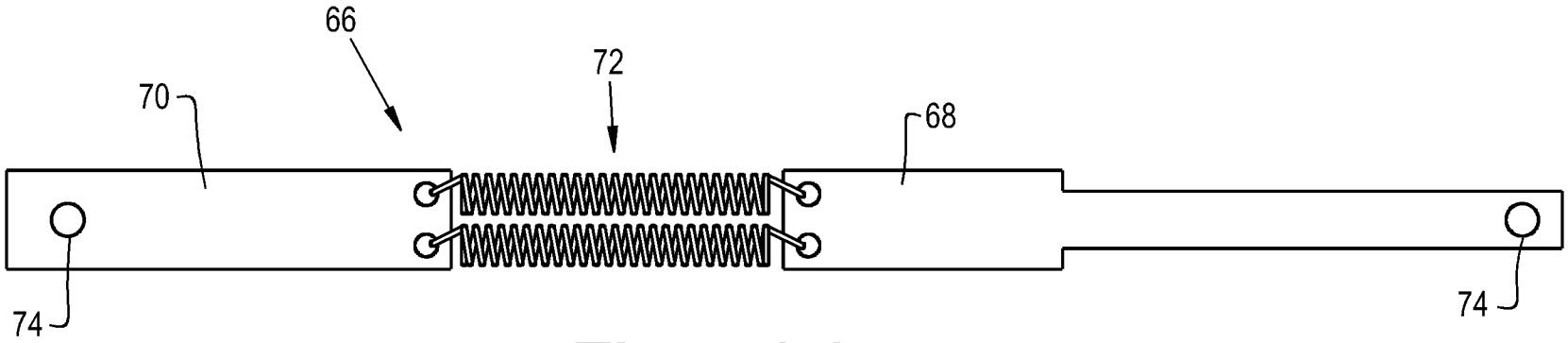
FIGS. 14A-14B illustrate the protective hinge assembly which generally includes strips interconnected by a flexible member.
Figure 14B:
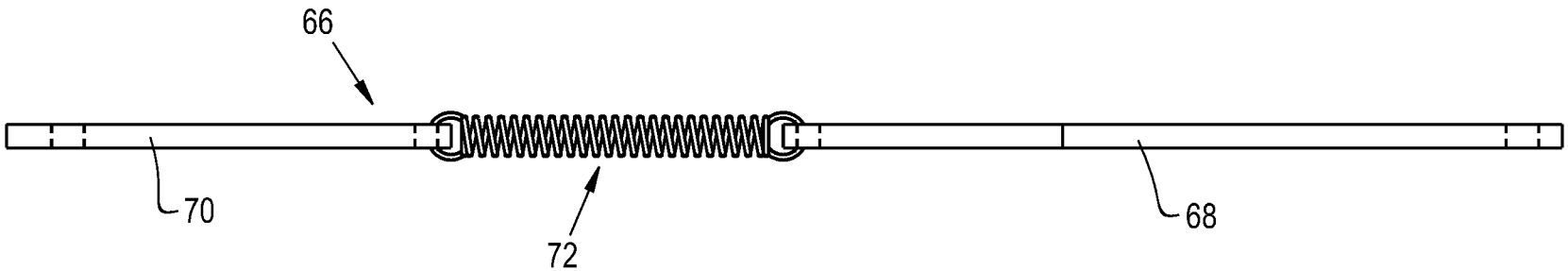

As shown in FIGS. 14A-14B, each protective hinge assembly 66 may include strips 68, 70 interconnected by a flexible member 72, such as one or more spring(s) 72. Due to the relationship of the strips 68, 70 and the springs 72, the strips 68, 72 can move relative to one another, expanding or retracting, in order to cover and protect at least a portion of the cables 42 and pulleys 44, 44' throughout the range of motion of the ladder 14. Further, the protective hinge assembly 66 may include a mechanical lock feature due to its structural design such that the ladder 14 may mechanically lock into the unfolded position by utilizing the tension on the cable 42 and the relationship between the protective hinge assembly 66 and the hinge(s) 30, 34.

The strips 68, 70 may each include one or more mounting holes 74 which receive fasteners 76 for attaching the protective hinge assemblies 66 to each hinge 30, 34. Thereby, the strips 68, 70 may be mounted to the inside and/or outside of the stabilizing portion 16, the first stair portion 18, and/or the second stair portion 20. The strips 68, 70 may be composed of any desired material, such as an ultra-high-molecular-weight (UHMW) polyurethane. One or both of the strips 68, 70 may have a shape which corresponds to the structure and travel path of the hinge(s) 30, 34. For example, the strip 68 may have a thinner portion which rests flush with at least a portion of the hinge(s) 30, 34 (FIG. 13).

The springs 72 may help to retain tension and allow the necessary extension for the ladder 14 as it rotates between the folded and unfolded positions. The springs 72 may also limit the rotational movement of the hinges 30, 34. Thereby, the ladder 14 may mechanically lock into the unfolded position by utilizing the tension on the cable 42 and the springs 72, and the physical stop built into the hinges 30, 34. The springs 72 may be in the form of any desired commercially available spring.

The length, width, and other structural dimensions of the ladder 14 as shown throughout FIGS. 1-12 are for exemplary purposes only and should not be construed as limiting in any manner. For instance, the ladder 14 may have a longer length than shown, where it is foldable at or near the midpoint of the ladder 14. Further, a longer ladder 14 may have a greater thickness throughout substantially all of or at least a portion of one or more of each ladder portion 16, 18, 20, the cable 42 may be thicker, each pully 44, 44 may have a larger radius, and so on. Additionally, for example, the longer ladder 14 may not need to be thicker in its depth dimension until the ladder 14 reaches a length which the ladder 14 may not be able to hold the leverage forces.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A folding ladder, comprising:

a stabilizing portion defining a stabilizing plane;

a first stair portion pivotably connected to the stabilizing portion, said first stair portion pivoting relative to said stabilizing portion in a first direction of rotation;

a second stair portion pivotably connected to the first stair portion, said second stair portion pivoting relative to said first stair portion in a second direction of rotation which is opposite to said first direction of rotation of the first stair portion such that said ladder selectively folds between a folded position and an unfolded position, and in the unfolded position said first stair portion defines a first stair angle, which is angled with respect to said stabilizing plane, and said second stair portion defines a second stair angle, which is angled with respect to said stabilizing plane and different than the first stair angle;

a tensioning system including a tensioner internally disposed within the stabilizing portion and a cable having a first end fixedly connected to the tensioner and a second end fixedly connected to the second stair portion, said tensioner being configured for pre-tensioning said cable, and said cable being internally disposed within said stabilizing portion and said first and second stair portions such that said cable locks said ladder in the unfolded position, said tensioning system further including a first pulley adjacent to a first pivot connection between the stabilizing portion and the first stair portion and a second pulley adjacent to a second pivot connection between the first stair portion and the second stair portion, and said cable at least partially wrapping around the first pulley and the second pulley; and a first protective hinge assembly and a second protective hinge assembly each being respectively coupled with the first and second stair portions, the first and second protective hinge assemblies are configured for protecting and at least partially covering the cable and the first and second pulleys, and each first and second protective hinge assembly includes a pair of strips interconnected to one another by a flexible member.

2. The folding ladder of claim 1, wherein in said folded position said first stair portion and said second stair portion are parallel with one another, and in said unfolded position said first stair portion defines the first stair angle, and said second stair portion defines the second stair angle that is vertical, which is perpendicular relative to said stabilizing plane.

3. The folding ladder of claim 1, wherein said cable is not fully taut when the ladder is in the folded position, and the cable is fully taut when the ladder is in the unfolded position.

4. The folding ladder of claim 1, wherein said stabilizing portion is a mounting portion which includes a pair of mounting rails that pivotally mount the first stair portion.

5. The folding ladder of claim 4, wherein said stabilizing portion further includes a pair of surface rails that are configured for mounting to a surface so that said folding ladder is selectively removable from said surface.

6. The folding ladder of claim 5, wherein said mounting rails each include a protrusion and said surface rails each include a corresponding channel such that said mounting rails slideably engage with said surface rails.

* * * * *